United States Patent [19]

Lee

[11] 4,204,776

[45] May 27, 1980

[54] TELETYPEWRITER

[76] Inventor: James C. C. Lee, 23, (8B) Nuan An St., Taipei, Taiwan

[21] Appl. No.: 934,170

[22] Filed: Aug. 16, 1978

[51] Int. Cl.[2] ..... B41J 3/20; B41J 19/30

[52] U.S. Cl. ..... 400/119; 400/320; 400/322; 400/328

[58] Field of Search ..... 400/118–121, 400/320, 320.1, 322, 328, 568, 617; 178/17 R, 17 A, 17 C, 81

[56] References Cited

U.S. PATENT DOCUMENTS

| | | | |
|---|---|---|---|
| 3,509,980 | 5/1970 | Loughry et al. | 400/120 |
| 3,532,205 | 10/1970 | Ozaki et al. | 400/328 X |
| 3,710,912 | 1/1973 | Bretti et al. | 400/328 X |
| 3,757,922 | 9/1973 | Sweeney | 400/328 X |
| 3,810,192 | 5/1974 | Okabe | 400/617 X |
| 3,826,915 | 7/1974 | Giolitti et al. | 400/119 X |
| 3,934,698 | 1/1976 | McGourty | 400/120 X |
| 3,987,882 | 10/1976 | Kobryn | 400/120 |
| 4,040,511 | 8/1977 | Beaven et al. | 400/568 X |

*Primary Examiner*—Paul T. Sewell
*Attorney, Agent, or Firm*—Bruce L. Birchard

[57] ABSTRACT

By utilizing as the driving elements for paper positioning and printing head positioning two solenoids, only, with appropriate electrical and mechanical timing control apparatus to assure synchronization of printing and related functions a low cost, portable, low weight, low-power-consumption teletypewriter can be realized.

10 Claims, 14 Drawing Figures

| | | | | | | | | |
|---|---|---|---|---|---|---|---|---|
| 000 | | H | P | X | | < | 0 | 8 |
| 001 | A | I | Q | Y | ! | > | 1 | 9 |
| 010 | B | J | R | Z | " | | 2 | : |
| 011 | C | K | S | | # | + | 3 | ; |
| 100 | D | L | T | | $ | , | 4 | |
| 101 | E | M | U | | % | - | 5 | = |
| 110 | F | N | V | | & | . | 6 | |
| 111 | G | O | W | | / | / | 7 | ? |
| 000 | 001 | 010 | 011 | 100 | 101 | 110 | 111 | |
Fig. 4
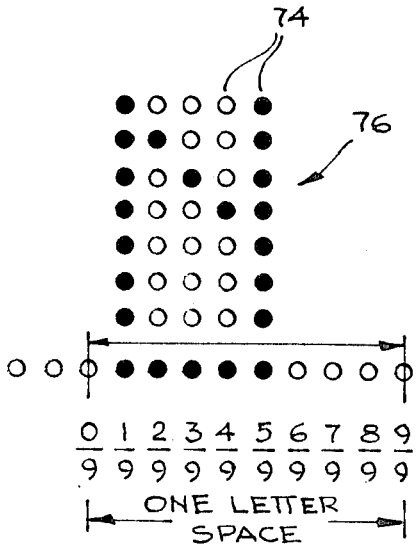
Fig. 5
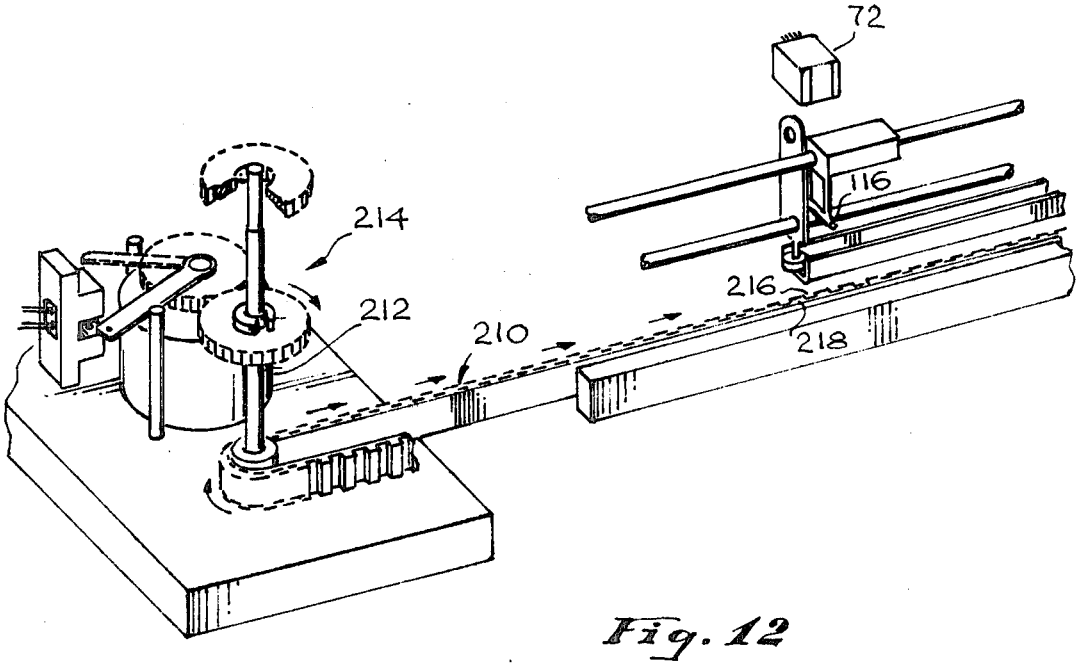
Fig. 12

TELETYPEWRITER

BACKGROUND OF THE INVENTION

1. Field of the Invention

This invention relates to teletypewriter machines and more specifically to such machines which can be used on a portable basis without external power.

2. Prior Art

Teletypewriter machines have been in widespread use for more than a quarter of a century. Generally, they have been large, heavy fixed machines located in business offices and used for national and international business transactions. They have served, more recently, as data input and output equipment for computers, i.e., as peripheral equipment.

In recent years there has been an increasing need for remote terminals for teletypewriter systems and for computer networks. The most recent entrants into the portable terminal field (to applicant's knowledge) are the machines manufactured by Micon Industries of Oakland, CA 94607. These machines weigh 6–14 pounds, cost approximately $1,000 and are intended primarily for computer I/O applications. To the best of applicant's knowledge the printer version of the Micon devices weighs 14 lbs. and is motor powered, which raises the machine's weight and power consumption. Further, it uses thermal printing which further increases power consumption and battery capacity requirements.

Attention is also directed to U.S. Pat. No. 3,493,091 (Kapp) which shows multiple solenoids used in shifting a printing head so that one of two type bands thereon is moved selectively, into an operative position. A stepping motor (of relatively high current consumption) is used for moving the printing drum.

SUMMARY OF THE INVENTION

It is one object of this invention to overcome the general disadvantages of problems set forth hereinbefore.

It is an additional object of this invention to provide a teletypewriter which is lightweight, of low power consumption and is particularly well adapted to portable use away from sources of power, such as the power mains found in offices.

Stated succinctly, by eliminating the synchronous motor normally used to provide mechanical power for head shifting and paper feeding and substituting two solenoids which operate only momentarily in accomplishing the required mechanical motion, providing electronic and electro-mechanical control of the printing head motion and printing functions so as to assure consistent font characteristics, and synchronizing related operations by a central electronic clock, a lightweight, portable printing teletypewriter may be realized. It may be provided with storage to simulate the paper tape storage available with present teletypewriting machines, without the attendant weight and power consumption.

BRIEF DESCRIPTION OF THE DRAWINGS

The novel features of my invention are set forth in the appended claims. The manner of operation of my invention can best be understood by referring to the following drawings, in which:

FIG. 4 is a plot of a possible binary encoding scheme for letters and symbols of the keyboard of FIG. 2;

FIG. 5 is a diagram showing the composition of a letter or symbol printed by the teletypewriter built according to my invention;

FIG. 12 is a perspective view of an alternative mechanism for driving the printing head, according to this invention.

DETAILED DESCRIPTION OF THE PREFERRED EMBODIMENT

Figure 1:
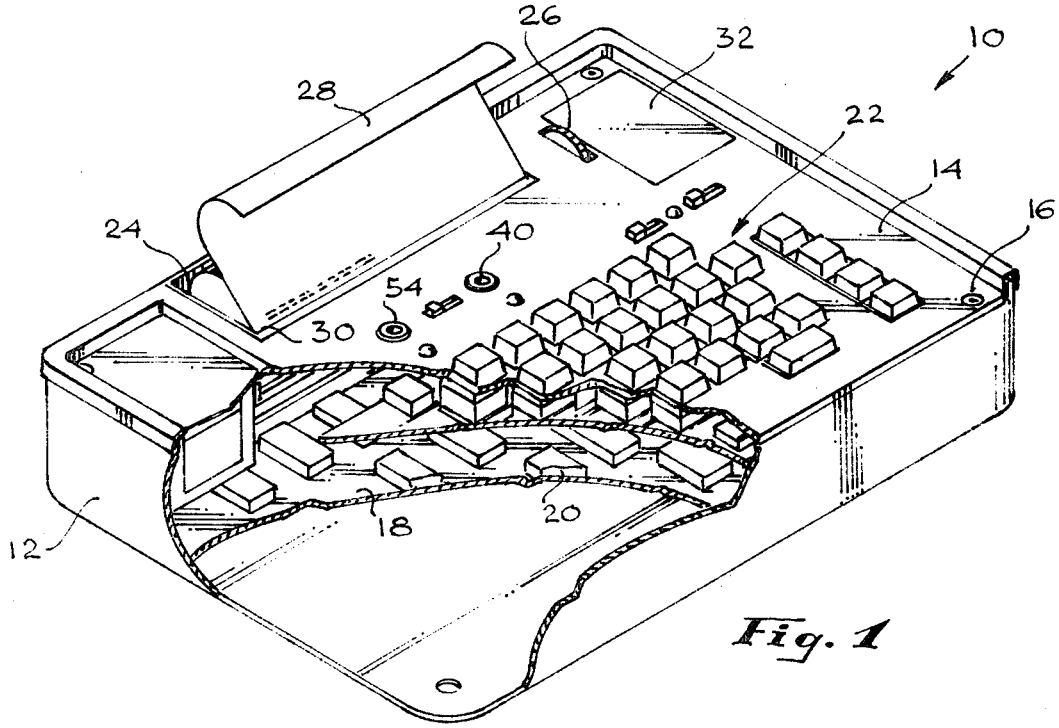
FIG. 1 is a cut-away drawing of a teletypewriter according to my invention.

In FIG. 1, teletypewriter 10 includes case 12 with top plate 14 secured to case 12 by bolts, or other securing, means 16. Case 12 carries P-C board 18 on which are mounted the various I-C's 20 utilized in my teletypewriter, as described more fully hereinafter. Carried in cover or top-plate 14 is the keyboard 22 made up, for example, of fourty-two character keys, one shift key, one space key and four memory keys. Paper drum 24, which can be manually rotated by paper-feed knob 26 is positioned adjacent paper slot 30. Slot 30 is provided for the feeding of paper 28 from drum 24 to the outside of teletypewriter 10. Cover 32 encloses the battery compartment in case 12. Various input connectors, such as microphone and speaker connectors 54 and 40, respectively, and indicators are also provided in top-plate 14.

Figure 2:
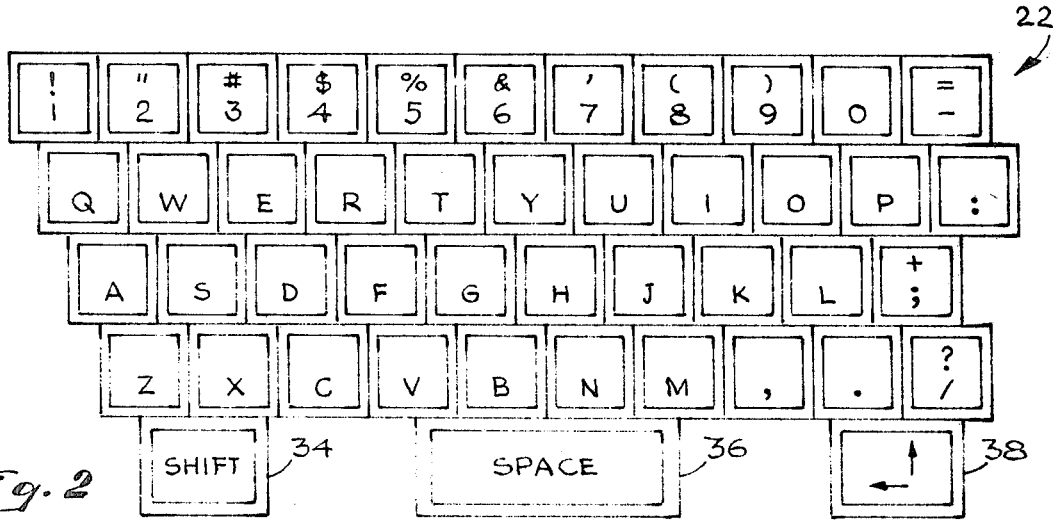
FIG. 2 is a plan view of a keyboard to be used in my invention.

The keyboard 22 is shown in more detail in FIG. 2. The Roman alphabet, Arabic numerals and commonly used symbols are shown, in addition to shift key 34, space key 36 and head return-paper feed key 38. Obviously, other alphabets or syllabaries may be used, for example Katakana or Farsi.

Figure 3:
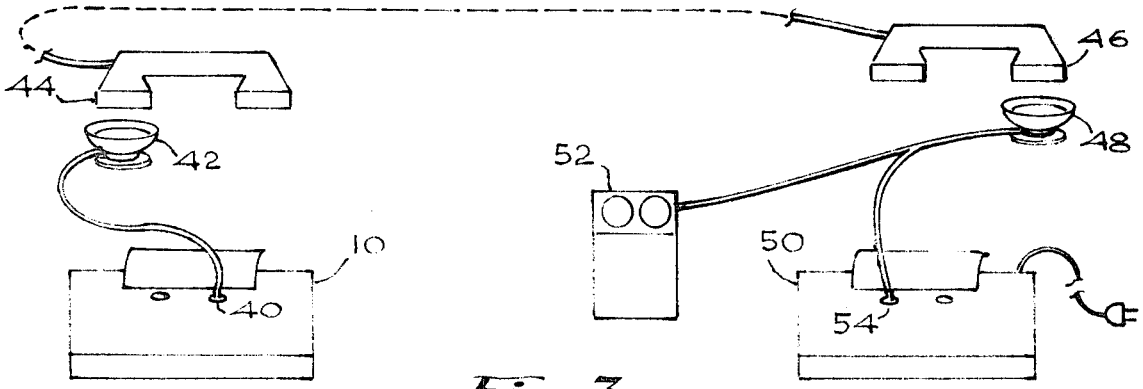
FIG. 3 is a diagram showing the intercoupling of two teletypewriters, according to my invention.

In FIG. 3, acoustic coupling in and out of two, coupled teletypewriters, according to my invention, is shown. Character tones generated within teletypewriter 10 may be taken from jack 40 and feed through loudspeaker 42 to the transmitter 44 of a conventional telephone which is coupled by the regular telephone system trunks to the receiver portion 46 of a second telephone instrument. The tones received by receiver 46 are coupled to a microphone 48, which, in turn, is coupled to a second teletypewriter 50 through connector 54 and, if desired, to an audio tape recorder 52. First machine 10 may be internally powered (i.e. battery operated) and second machine 50 may be operated from the a.c. mains.

The binary addresses of the characters of keyboard 22 are shown in FIG. 4. For example the letter "A" has the address of 000,001. Those addresses in the matrix which show "O"'s are addresses in memory of automatic machine instructions.

The characters utilized according to one embodiment of my invention, are of standard ASCII font such as are generated by MOS chip 3257 which is available from Fairchild Semiconductor Corporation, 464 Ellis Ct., Mountain View, CA 94042.

Each letter is formed within a 7×5 dot matrix, such as is shown in FIG. 5. In this particular embodiment the printing is by means of electrical discharge from a 35-pin head to be described more fully hereinafter. The total horizontal space assigned to a character is, for example, 2.4 mm. If that space is divided into 9 equal segments the results are as shown in FIG. 5, with five spaces assigned to character formation, one to "ready-print" information and four to blank space.

To keep these spaces equal in width despite speed variations in the driving mechanism a timing wheel 60 is provided. It has six slots 62 spaced 40° apart over two-thirds of the periphery of wheel 60. These slots permit passage of light from light-source 64 to photo-sensor 66. Thus, as wheel 60 rotates in response to the depression of letter or character keys, wheel 60 rotates through 360° and generates six "on" periods at the output terminals 68, 70 of photo-sensor 66. These "on" periods control when discharge may occur from the dot-matrix discharge head 72 (see FIGS. 9, 10, 11, 12) and tend to produce equal spacing of rows 74 in dot matrix 76 of FIG. 5, despite speed variations in the electro-mechanical drive to the printing head.

Figure 7:
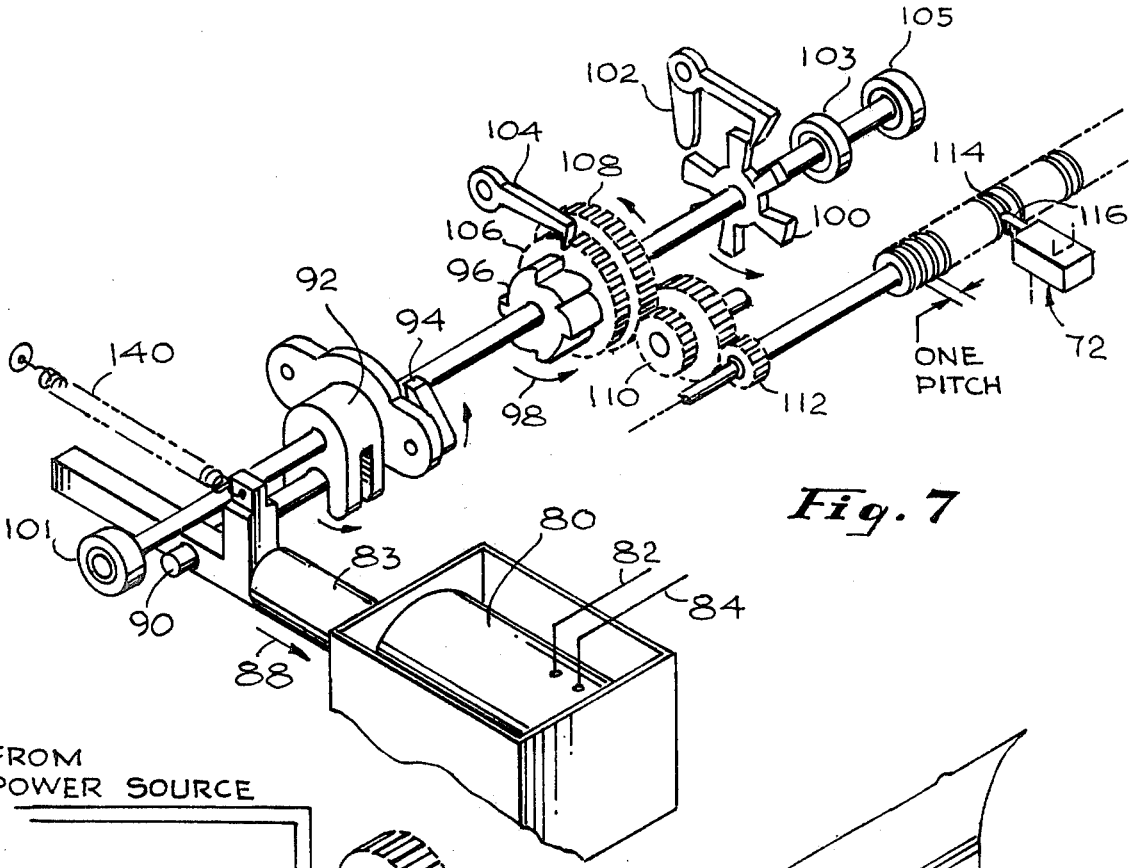
FIG. 7 is a perspective view, partially exploded, showing the printing head shifting mechanism, according to my invention.

The overall head-moving electro-mechanical system, with low power consumption, is shown in FIG. 7. In FIG. 7, solenoid 80 is the prime-mover for the system which moves printing head 72. When solenoid 80 is energized through leads 82 and 84 in response to a character or space key's being depressed in keyboard 22 plunger 83 moves to the right (in the direction of arrow 88) in FIG. 7, carrying with it rod 90 which drives cam assembly 92 and pitch pin 94 causing pitch rotor 96 to move an angular amount (60°) equivalent to one pitch distance in the direction of arrow 98. Pitch wheel 100, which is fixed to a common shaft with pitch rotor 96, is stopped accurately at one pitch-equivalent motion by pitch cam-stopper 102. Pawl 104 engages gear 106 to prevent its reverse rotation. Support bearings 101, 103 and 105 are also provided.

The ratio of the gear train including gears 108, and 110 and pinion 112 is such as to produce one, 360° rotation of pinion 112, (and, hence of worm 114) for each one pitch movement of rotor 96. Such one, 360° rotation of worm 114 advances printing head 72 one letter space (about 2.4 mm), by reason of the engagement of tracking pin 116 in the track of worm 114.

Figure 8:
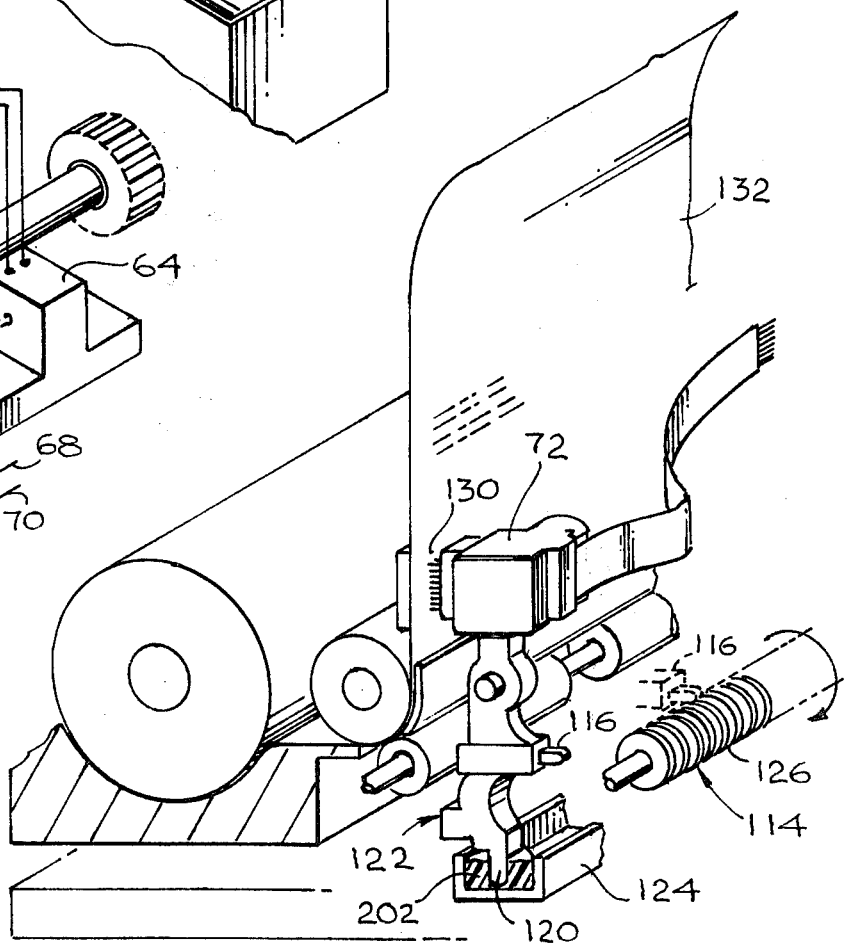
FIG. 8 is a perspective view of a portion of the head shifting mechanism of FIG. 7.

The details of the head driving by screw or worm 114 may be seen more clearly in FIG. 8. Foot 120 of head assembly 122 (which includes printing head 72 and tracking pin 116) rides in rail 124 (supported by roller 202). Tracking pin 116 engages helical groove 126 in worm or screw 114. When worm 114 rotates 360°, head assembly 122 is moved a total of one letter space (to the right in this drawing). At the same time it is moving, head 72 is energized according to a predetermined pattern set by the key which was depressed in keyboard 22.

Figure 6:
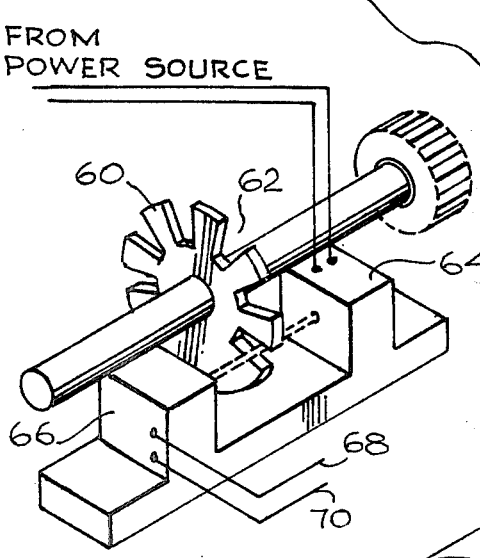
FIG. 6 is a perspective drawing of a printer timing system utilized in my invention.

Timing wheel 60 (See FIG. 6) permits electrical discharge from pins 130 when slots 62 are aligned with the light path from light source 24 to sensor 66 (FIG. 6). An appropriate pattern is burnt onto aluminum (or other conductor) backed paper 132.

The return of plunger 82 (FIG. 7) to its original position following de-energization is assured by spring 140 and by the fact that there is cam-coupling (not solid coupling) between shaft 90 and pitch rotor 96.

Figure 9:
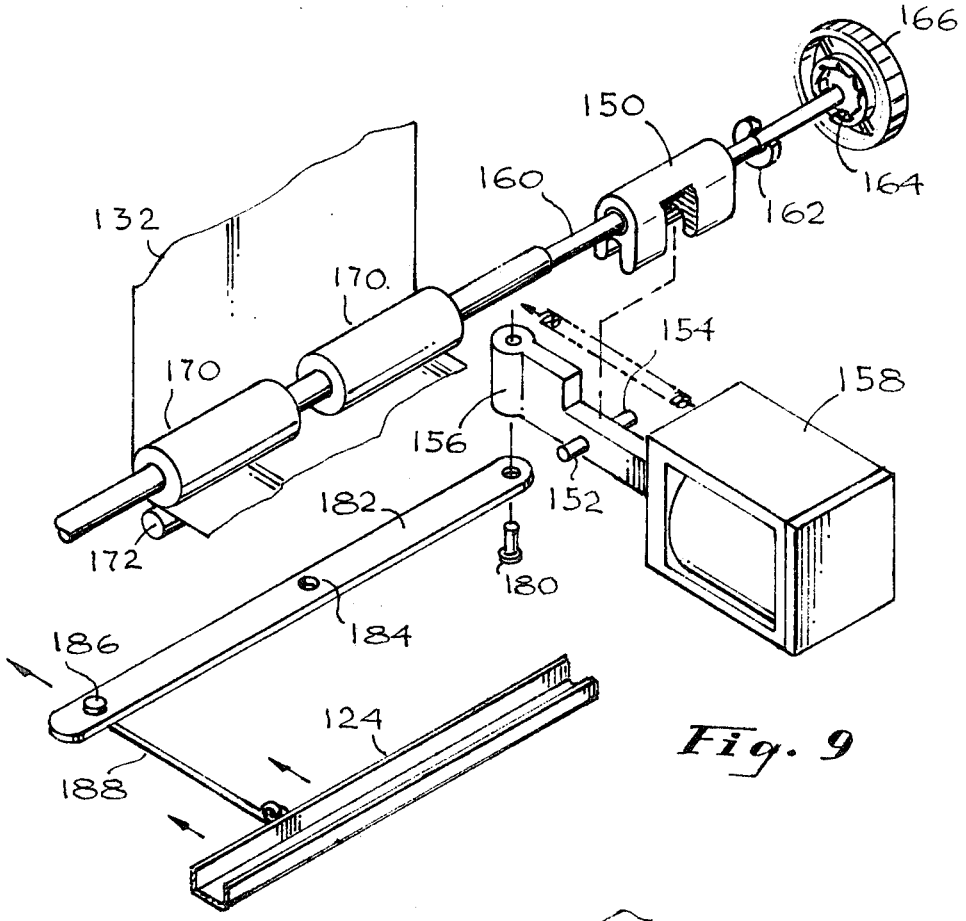
FIG. 9 is a perspective view, partially exploded, showing the paper advance mechanism according to my invention.
Figure 10:
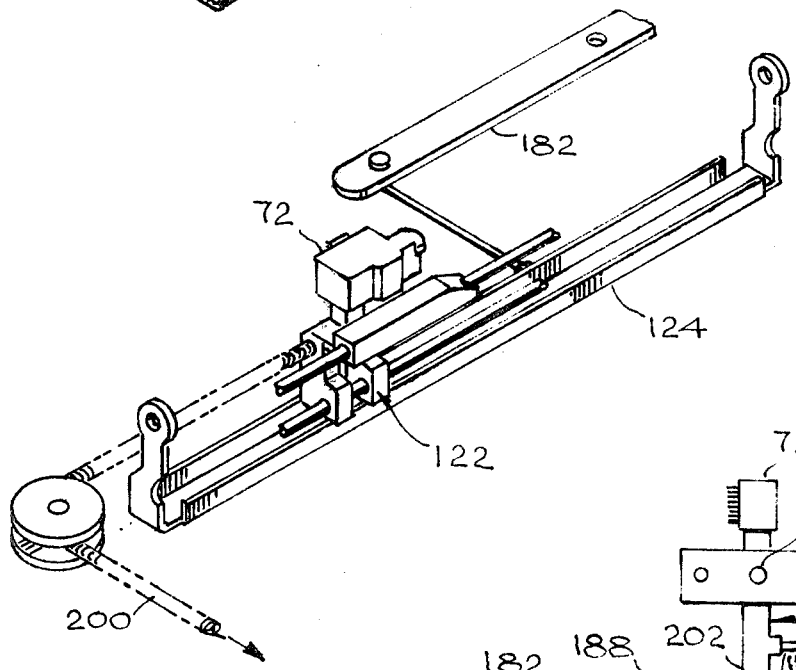
FIG. 10 is a perspective view of a portion of the printing head carriage mechanism, according to my invention.
Figure 11:
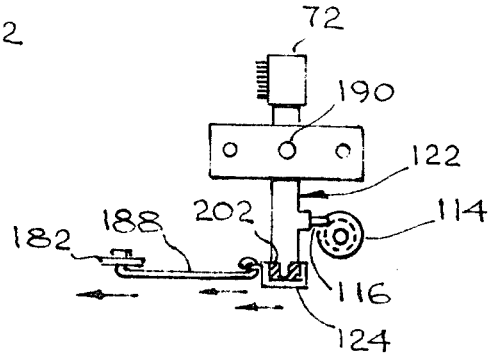
FIG. 11 is an elevation view of a portion of the head carriage mechanism of FIG. 10.

The apparatus by which the sole remaining electro-mechanical drive element (solenoid 158) effects all remaining necessary mechanical motion is set forth in FIGS. 9, 10 and 11.

In FIG. 9, yoke 150, when in operating position, engages, in releasable fashion, pins 152 and 154 on plunger 156 of solenoid 158 and is free to rotate about shaft 160 over which it is positioned. Ratchet pin 162 moves in concert with yoke 150 and, if solenoid 158 is energized, pin 162 engages gear 164 in feed wheel 166. Wheel 166 is fixed on shaft 160 or an extension thereof, and motion of wheel 166 by reason of engagement between pin 162 and gear 164 and energization of solenoid 158 results in rotation of shaft 160 and rollers 170 (in combination with roller 172) causing paper 132 to be fed out by a length equal to the desired distance between printed lines.

When paper feeding is occurring it is desirable to disengage head 72 from the paper 132. To achieve that end, solenoid 158, which also activates the paper feeding, is utilized. Pin 180 connects plunger 156 pivotally to swing-lever 182 which is pivoted about central hole 184. Pivot pin 186, in the remote end of swing-lever 182, is coupled through linkage 188 to rail 124. (See also FIGS. 8, 10 and 11). Foot 120 of head assembly 122 (FIG. 8) rides in rail 124. When solenoid 158 is energized to feed paper 132, swing-lever 182 pivots about point 184 causing rail 124 to move away from worm 114, disengaging tracking pin 116 from the grooves of worm 114 and pivoting head assembly 122 around rod 190 (FIG. 11).

The return of head assembly 122 to the left margin during the paper-feed step is assured by spring 200 attached to assembly 122 and biasing it to the left, as shown in FIG. 10. Foot 120 of head assembly 122 is surrounded by roller 202 which slides in rail 124.

Linear solenoids 80 and 158 may be replaced by rotary solenoids.

To replace solenoid 80 by a rotary solenoid the structure of FIG. 12 may be utilized. In FIG. 12 worm 126 of FIG. 8 has been replaced by toothed belt 210 which receives its motivation from rotary solenoid 212 through a gear train 214. Tracking pin 116 is positioned between two adjacent teeth, for example teeth 216 and 218, and is moved thereby as belt 210 moves.

Figure 13:
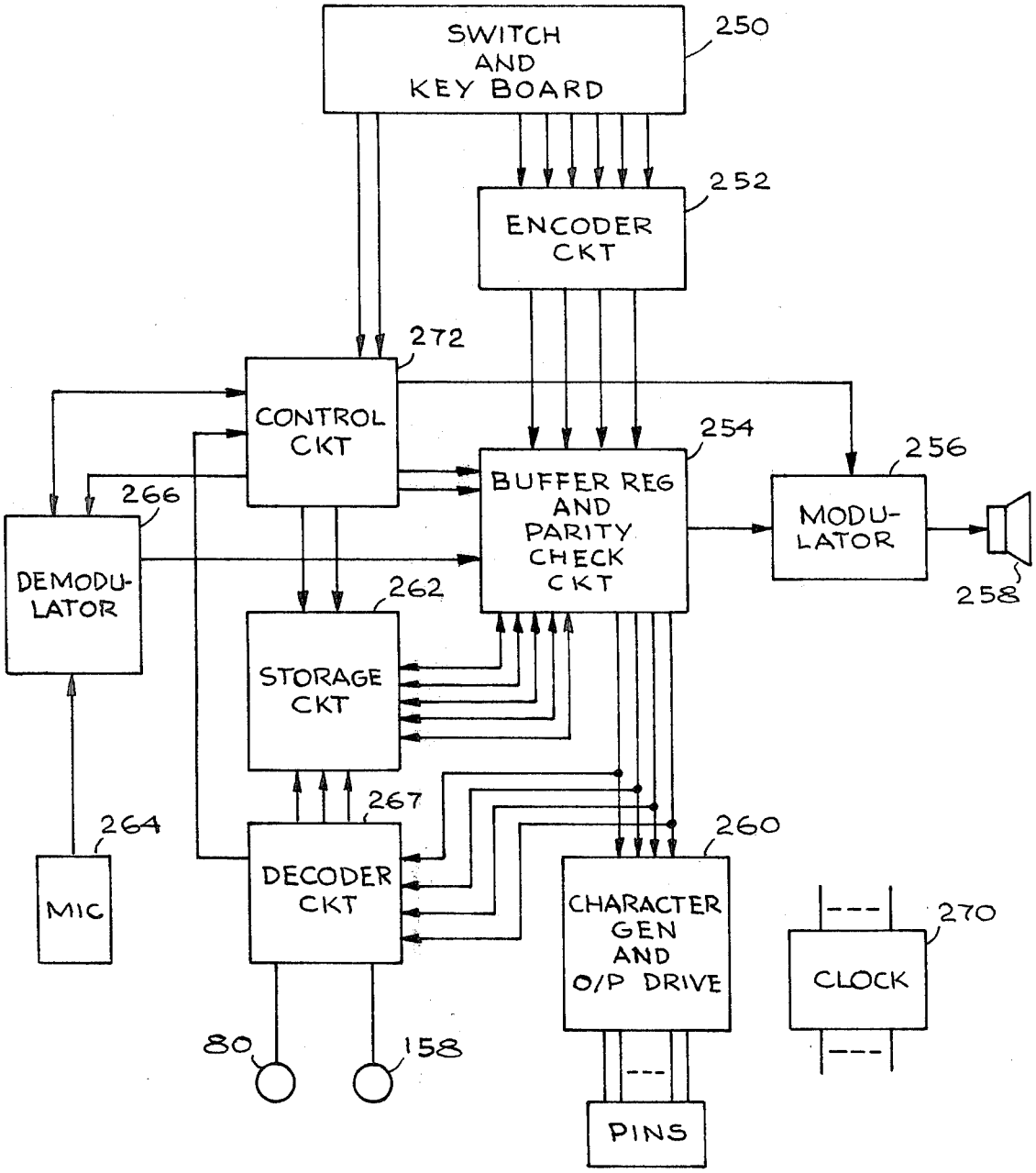
FIG. 13 is a block diagram of the electrical and electronic portions of the teletypewriter according to my invention.

FIG. 13 is an overall block diagram of the electronic portion of the teletypewriter incorporating my invention.

The keyboard 250 is a standard ASCII board. Its key matrix is coupled to an ASCII encoder 252 of the type widely available, as for example, from Fairchild Semiconductor Co., 464 Ellis Ct., Mountain View, CA. 94042.

The encoded signals enter buffer register 254 from which they may be read out to FSK modulator 256 and thence to loudspeaker 258 for coupling to a telephone transmitter, as shown in FIG. 3. Alternatively they may be read out to character generator and output drive 260 which may be Fairchild MOS Type No. 3257.

Instead of immediately transmitting each character signal as it is generated it may be stored in RAM 262 which is made up of six Fairchild Type 2102 I-C chips. This gives 1000 letter storage. Such capability replaces the paper tape capability of standard teletypewriters.

Solenoids 80 and 158 get their printing instructions either directly from buffer register 254 or from microphone 264 acoustically coupled to a telephone receiver and electrically coupled to demodulator 266 which translates the received FSK signal 268 (shown in FIG. 14) into "zeroes" and "ones" (binary signals) to operate the logic circuits and, ultimately, drive solenoids 80 and 158 to print alphanumeric information. A central clock 270 maintains synchronism in the circuit. This clock may be included in demodulator chip 266 or in control circuit 272.

Figure 14:
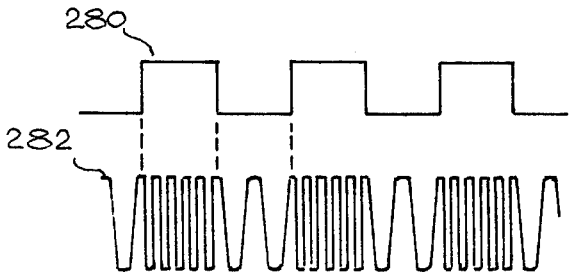
FIG. 14 is a diagram showing certain time-amplitude-frequency relationships utilized in my invention.

In FIG. 14, pulse signal 280 translates into a frequency-shift signal 282 with "ones" becoming high frequency signals (say, 2000 Hz) and "zeroes" being low frequency signals (say 500 Hz).

While a particular embodiment of my invention has been shown and described, it will be apparent to one skilled in the art that variations and modifications may be made without departing from the spirit or scope of my invention. It is the intention of the appended claims to cover all such variations and modifications.

I claim:

1. An improved teletypewriter, including:

a base portion;

power means supported in said base portion for providing electrical power to said teletypewriter for the operation thereof;

a first solenoid supported from said base and having a plunger which is moved upon the application of electrical current from said power means to said first solenoid;

a keyboard supported from said base portion and having individual character keys, each of which has associated therewith an electrical circuit which is coupled to said power means and to said first solenoid and is effective upon the depression of such key to apply electrical current to said first solenoid from said power means;

a lateral track swingably supported from said base portion;

a printing-head assembly movable laterally along and guided by said track and rotatable about an axis substantially parallel to said track;

head translating means coupled between said first solenoid and said printing-head assembly and responsive to motion of said first plunger to translate said head assembly a predetermined distance along said track, said head translating means including a worm, having a helical groove and an axis, coupled to said first solenoid and supported for rotation about the axis of said worm, said axis being substantially parallel to said track;

a platen supported from said base portion parallel to said track and adapted for the passage of paper thereover;

said printing-head assembly including a printing head portion movably positioned adjacent said platen for movement thereacross and rotatable about an axis parallel to said platen, a foot portion slidably engaging said track and guiding the motion of said printing-head portion and a groove-tracking pin in engagement with said groove in said worm;

paper-feeding means including a shaft having rollers on one portion thereof, a paper feed knob carried at one end thereof and rotatable therewith and a yoke rotatably carried by said shaft, said yoke having a ratchet pin affixed to one end thereof coaxially with said shaft, but in a plane normal to said shaft, said feed knob having a ratchet portion in engagement with said ratchet pin, whereby motion of said ratchet pin in one direction rotates said knob and said shaft;

a second plunger having operatively associated therewith a second solenoid and having a yoke receiving portion for engaging said yoke and rotating said yoke upon motion of said second plunger, said yoke being in engagement with said yoke receiving portion;

a swing-lever coupled to said second plunger and said track and responsive to the motion of said second plunger into said second solenoid to swing said track away from said worm and said groove-tracking pin of said printing-head assembly out of said helical groove, whereby said head assembly may be freely slid along said track; and, feed-control means coupled to said second solenoid for controlling the activation thereof.

2. Apparatus according to claim 1 which includes a timing wheel coupled to said worm.

3. Apparatus according to claim 1 in which said printing head includes electrical discharge pins.

4. Apparatus according to claim 3 which includes, in addition, control means for selectively activating said electrical discharge pins.

5. Apparatus according to claim 4 in which said control means includes a timing wheel driven in conjunction with said worm.

6. Apparatus according to claim 5 which includes, in addition, an aligned light source and a photo-sensor positioned for the breaking of the light path to said sensor by said timing wheel.

7. Apparatus according to claim 1 which includes, in addition, means for returning said head assembly to the left extremity of said track.

8. Apparatus according to claim 1 which includes, in addition, storage means for storing information as to which of said character keys is depressed.

9. Apparatus according to claim 8 in which said storage means includes semiconductor RAM's.

10. Apparatus according to claim 1 which includes, in addition, means for restoring said first and second plungers to their inactivated positions out of their respective solenoids when such solenoids are no longer receiving power from said power means.

* * * * *